United States Patent [19]

Howard

[11] Patent Number: 4,839,478

[45] Date of Patent: Jun. 13, 1989

[54] PUSH BUTTON SAFETY SWITCH

[75] Inventor: William A. Howard, Burton, Ohio

[73] Assignee: Delta Systems, Inc., Streetsboro, Ohio

[21] Appl. No.: 157,883

[22] Filed: Feb. 19, 1988

[51] Int. Cl.[4] ..... H01H 27/00

[52] U.S. Cl. ..... 200/52 R; 200/61.19

[58] Field of Search ..... 200/52 R, 161, 61.76, 200/61.84, 61.62, 159 A, 159 R, 61.19

[56] References Cited

U.S. PATENT DOCUMENTS

| | | | |
|---|---|---|---|
| Re. 29,426 | 10/1977 | Giroux | 200/161 X |
| 3,060,285 | 10/1962 | Steinbruner | 200/159 A X |
| 3,210,494 | 10/1965 | Murdock | 200/161 X |
| 3,689,717 | 9/1972 | Westenhaver | 200/61.19 |

*Primary Examiner*—A. D. Pellinen

*Assistant Examiner*—Morris Ginsburg

*Attorney, Agent, or Firm*—Watts, Hoffmann, Fisher & Heinke

[57] ABSTRACT

A push button safety switch. A pair of switch terminals are mounted within a housing which also carries a plunger for movement relative to the housing. The plunger is biased for movement along a path of travel by a compressed spring. A push button actuator has a knob for contact by user and a plunger actuator carried by the knob. The actuator also defines a stem portion to support a tether clip coupled to the boat operator. The boat motor ignition circuit is electrically connected to the switch terminals and the motor can be de-activated by either user contact with the knob or through movement of the plunger initiated by separation of the tether clip from the push button actuator.

17 Claims, 4 Drawing Sheets

PUSH BUTTON SAFETY SWITCH

TECHNICAL FIELD

The present invention relates to a safety switch for de-activating a boat motor.

BACKGROUND ART

U.S. Pat. No. Re. 29,426 to Giroux discloses a safety switch for automatically de-activating a boat engine in the event a cord attached to the boat operator becomes separated from the safety switch. One instance of this happening would occur, for example, if the boat operator were thrown overboard and the cord were forcibly removed from the safety switch.

The safety switch disclosed in the Giroux patent also allows the boat operator to de-activate the boat motor in other than an emergency situation. By pressing a push button actuator, the boat operator can move a contact to a position to bridge two switch terminals coupled to the motor ignition circuit and thereby deactivate the boat motor. The safety switch uses two spring mechanisms within a safety switch housing. A first spring moves the contact to bridge the ignition circuit terminals in the event the cord is disconnected from the switch and a second spring biases the terminals away from the closed position in a way which can be easily overcome by user activation of the push button in the event it is desired to de-activate the boat motor.

One difficulty with the safety switch disclosed in the Giroux patent is that the boat motor cannot be easily re-activated once the cord is disconnected from the switch. To re-activate the boat motor, the operator must either reconnect the cord to the switch or pull the push button actuator while operating the motor.

DISCLOSURE OF THE INVENTION

The present invention relates to a safety switch mechanism for de-activating a boat motor. The present safety switch mechanism employs a single spring for positioning a pair of contacts for deactivating the boat motor. The safety switch is preferably combined with an idle adjustment knob attached to the boat tiller. A tether clip is also attached to a safety switch push button actuator. A boat operator can de-activate the boat motor intentionally or alternately, the safety switch automatically de-activates the motor if the tether clip is separated from the push button actuator.

A boat motor control switch constructed in accordance with one embodiment of the invention includes two spaced switch terminals coupled to a motor control circuit for de-activating the motor. The motor is de-energized by a switch plunger carrying first and second metal conductors spaced along the plunger.

The plunger is mounted for movement along a travel path. Movement of the plunger to a first position causes a first metal conductor to bridge a gap between the switch terminals. Movement of the plunger to a second position causes a second metal conductor to bridge the gap between switch terminals. A biasing spring engages the plunger to urge the actuator in one sense along the travel path to a position where the contacts are shorted by a first of the metal conductors.

A push button actuator and tether clip attached to the boat operator position the switch plunger in a position between the first and second positions so that neither the first nor the second metal conductor contact the switch terminals. This construction allows the user to push against the push button actuator to move the plunger along its travel path against the biasing action of the spring to cause the second metal conductor to bridge the switch terminals and de-activate the boat motor. An accident that causes the operator to fall overboard separates the tether clip from the push button actuator and allows the biasing spring to move the plunger along its travel path to a position where the first metal conductor bridges the gap between contact switch terminals and also de-activates the boat motor.

From the above, it is appreciated that one object of the invention is a safety switch having an actuator biased for movement by a single spring that allows a boat operator to de-activate a motor and that also automatically de-activates the motor in the event of an accident which causes a tether clip to separate from the actuator. Another object of the invention is a safety switch which will allow the boat operator to re-activate the motor after the tether clip is separated from the actuator by pressing the actuator. These and other objects, advantages, and features of the invention will be better understood from a review of one embodiment of the invention that is discussed below in conjunction with the accompanying drawings.

BEST MODE FOR CARRYING OUT THE INVENTION

Figure 1:
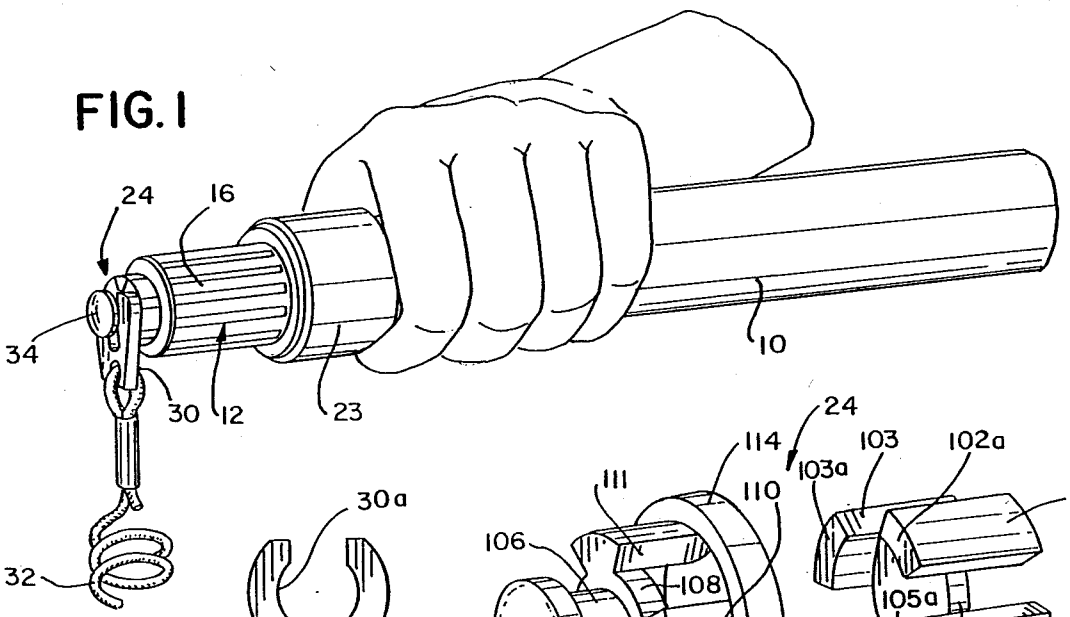
FIG. 1 is a perspective view of a boat motor tiller and push button safety switch actuator mounted to an idle throttle.
Figure 6:
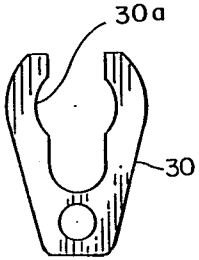
FIG. 6 is an elevation view of the tether clip.

Turning now to the drawings, FIG. 1 is a perspective view of a boat tiller 10 for maneuvering a boat. The tiller 10 is coupled to an outboard motor (not shown) which is pivotally mounted at the boat stern so that as the tiller is re-oriented by a boat operator the motor is also re-oriented. Coupled to one end of the tiller 10 is a throttle 12 for adjusting idle speed of the boat motor. By rotating the throttle 12 about a center axis of the tiller the boat operator adjusts the idle speed of the boat. This is particularly advantageous for use in trolling where the boat speed is adjusted to a desired rate as the operator maneuvers along a body of water while fishing.

Figure 2:
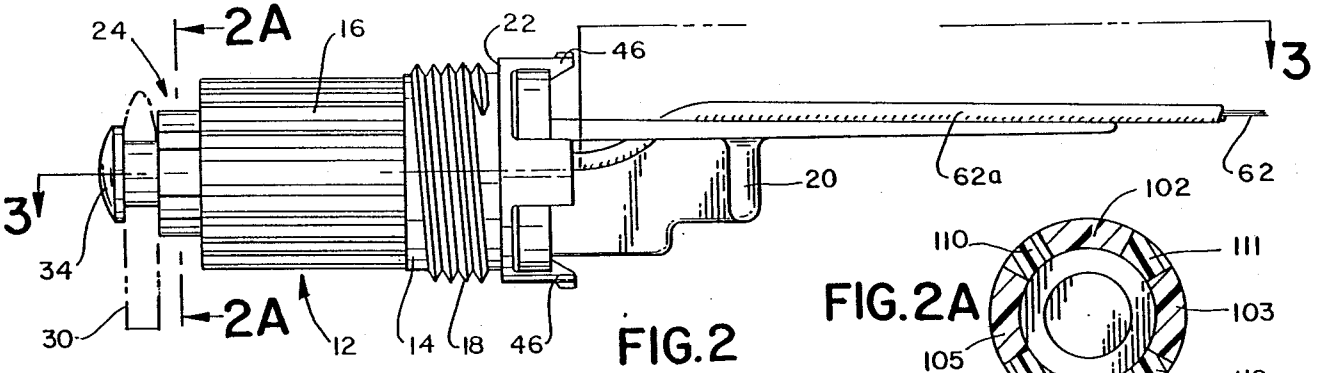
FIG. 2 is a side elevation view of the idle adjustment throttle showing a tether clip mounted to the safety switch actuator.
Figure 2A:
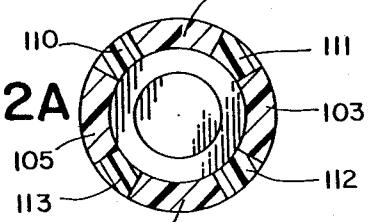
FIG. 2A is a section view as seen from the plane defined by the line 2A—2A in FIG. 2.
Figure 3:
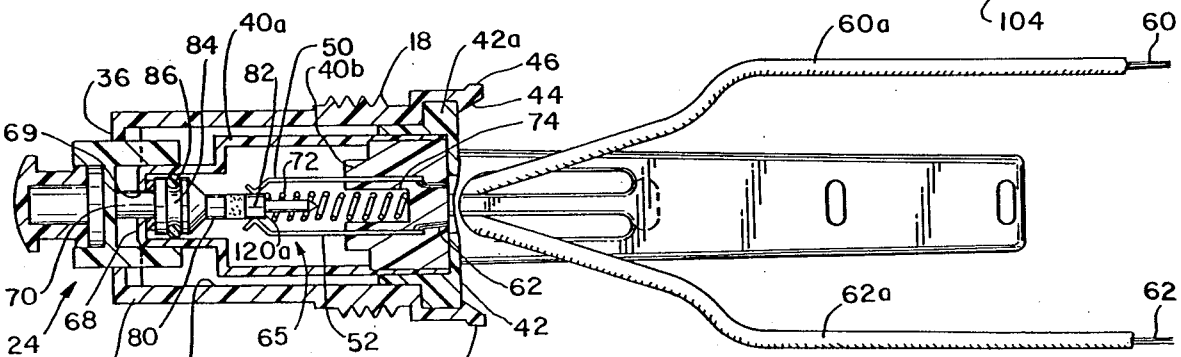
FIG. 3 is a partially sectioned view seen from the plane defined by the line 3—3 in FIG. 2.

As seen most clearly in FIGS. 2 and 3, the throttle 12 has a generally cylindrical plastic housing 14 having ridges or ribs 16 to allow the operator to better grasp the throttle and rotate it to adjust boat motor idle speed. The throttle housing 14 defines an outer threaded surface 18 that engages a correspondingly threaded interior surface (not shown) inside the tiller 10. As the operator rotates the throttle 12, the throttle housing 14 moves in or out of the tiller. An idle stop 20 coupled to the throttle housing 14 moves back and forth through the tiller 10 in response to this adjustment by the user. An idle control (not shown) extending through the tiller to the vicinity of the idle stop contacts the stop 20 and is repositioned in response to operator adjustment of the throttle 12. Outward movement of the throttle away from the tiller 10 is limited by a cylindrical shoulder 22 defined in the throttle housing 14 that engages an inwardly extending stop at the end of the tiller.

As seen in FIG. 1, a push button actuator 24 supports a tether clip 30 attached to a flexible line 32 which in turn can be attached to a boat operator by a belt clip or the like. In the event of an accident causing the operator to be thrown overboard or away from the tiller 10, the line 32 pulls on the tether clip 30 causing the clip to separate from the push button actuator 24. This causes the motor to be de-activated due to the operation of a safety switch mechanism discussed below. In addition, the operator can actuate the push button actuator 24. By pressing against a knob 34 to move the actuator 24 into the throttle housing 14. This action also de-activates the boat motor and provides a convenient mechanism for stopping the motor without having to reach backward to the motor ignition.

Turning now to FIG. 3, the throttle housing 14 defines a generally cylindrical interior cavity 35 open at either end. An exposed end of the housing 14 defines a circular shoulder or flange 36 that extends radially inward to define an opening to accommodate the push button actuator 24. At an end axially removed from the actuator 24 the housing cavity 35 is closed by a throttle base 42 that also defines the stop 20. The throttle base 42 supports a switch housing 40, consisting of a first switch housing portion **40*a* and a second switch housing portion 40*b*, within the cavity 35. Before the throttle housing 14 is mounted to the tiller 10 the switch housing 40*a*, 40*b* is mounted to the throttle base 42 ,and, the throttle base 42 and switch housing 40*a*, 40*b* into the throttle housing 14 until a flared outer portion 42*a* of the throttle base 42 contacts beveled surfaces 44 defined by four flexible latch arms 46 extending axially from the housing 14. Pressure against the beveled surfaces 44 by the outer portion 42*a* causes the arms 46 to flex outward and allow continued movement of the switch housing 40*a*, 40*b* into the cavity 35. The base 42 is locked in place when the arms 46** snap back into their unflexed state.

The switch housing supports two switch terminals 50, 52 in a cavity defined by first and second housing portions **40*a*, 40*b*. The first hollow portion 40*a* supports the base portion 40*b*. The two flexible switch terminals 50, 52 are supported by the base portion 40*b* and are electrically connected to two electrical conductors 60, 62 that pass through the base portion 40*b* and out openings in the base 42. Outside the housing 14, the conductors 60, 62 are insulated by conventional insulation 60*a*, 62*a* as seen in FIG. 3. The conductors 60, 62 are routed through the tiller 10 to the boat motor ignition circuit for de-energizing the boat motor. When the two contacts 50, 52** are shorted together, the boat motor is de-activated.

The terminals 50, 52 are embedded in the base **40*b* and extend outward into the cavity 65. Each flexible terminal is a copper band bent inward at one end so that when they are mounted to the base 40*b* a region of closest approach between the two terminals 50, 52** defines a shorting region.

The housing portion **40*a* defines a two-step cavity 65. At a narrower region the cavity 65 is generally cylindrical. The housing portion 40*a* has an end wall 68 which extends radially inward to define an opening 69. An elongated plunger 70 extends through this opening from the cavity 65 and slides back and forth along a path of travel defined by the combination of the housing portion 40*a* and a compression spring 72 trapped within a cylindrical well 74 in the base portion 40*b*. The plunger 70 carries two metallic bands or strips 80, 82 spaced by an insulating segment of the plunger 70 that selectively bridge the contacts 50, 52** to de-activate the motor.

Within the narrow cylindrical cavity defined by the housing portion **40*a*, the plunger 70 widens and then narrows to define a groove 84 which carries an elastomeric "O-ring" seal 86 that moves with the plunger 70. This seal 86 prevents dirt and water from entering the cavity 65 in the region of the switch terminals 50, 52**.

The push button actuator 24 is supported by the housing 14 and contacts an end surface of the plunger 70. Movement of the actuator 24 moves the plunger 70 which positions the two metal bands 80, 82 in relation to the terminals 50, 52. As seen most clearly in FIG. 5, the push button actuator 24 comprises a disk-like plunger actuator 100 connected to a set of four circumferentially spaced elongated supports 102–105. The actuator knob 34 is connected to a stem 106 that widens to a disk 108 connected to a second set of four elongated supports 110–113 interconnected by an annular ring 114.

The plunger actuating member 100 is movably supported within the ring 14 by interleaving the two sets of elongated supports 102–105, 110–113. This mounting allows relative movement between the knob 34 and the plunger actuator 100.

Figure 4A:
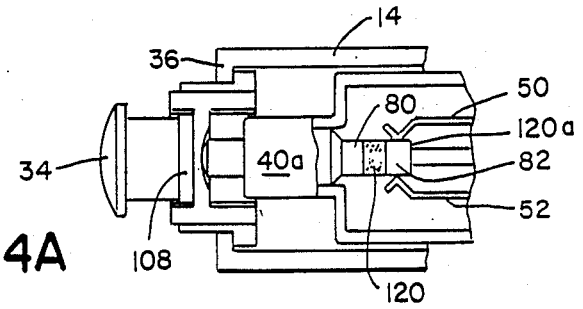
FIGS. 4A–4D schematically show relative positions between the idle throttle and the safety switch actuator.
Figure 4B:
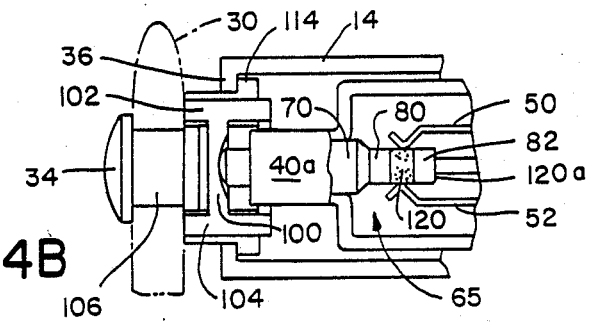

FIGS. 4A–4D depict four different relative positions for the knob 34 and plunger actuator 100. FIG. 4B illustrates a situation in which the two terminals 50, 52 are insulated from the two metal bands 80, 82 by an insulating portion 120 of the plunger 70 intermediate the two metal bands 80, 82.

As seen in FIG. 4B the annular ring 114 engages the circular flange 36 so that the knob 34 is fully extended, from the throttle 14. The plunger 70 is pushed inward relative to housing portion **40*a* by inward movement of the actuator 100 relative the k This occurs when the safety or tether clip 30 is pushed over the stem 106 forcing the actuator 100 to the position shown in FIG. 4B. The clip engages face or end surfaces 102*a*–105*a* of the elongated connectors 102–105 which causes the plunger actuator 100 to move into the throttle housing 14 to position the plunger 70**.

Turning now to FIG. 4A, a situation is depicted in which the tether clip 30 has been separated from the actuator 24. Since the tether 30 is coupled to the operator by the tether clip 30, when this occurs, the operator has presumably been separated from the tiller by an accident. When this occurs, the spring 72 (FIG. 3) pushes the plunger 70 along its path of travel, forcing the actuator 100 to move to the position depicted in FIG. 4A. Note that the ring 114 is still in contact with the shoulder 36 but that as the plunger 70 moves outward it has pushed the supports 102–105 into a region previously occupied by the tether clip 30. In this situation, the metal band 82 bridges the gap between terminals 50, 52 to de-activate the boat motor.

Figure 4C:
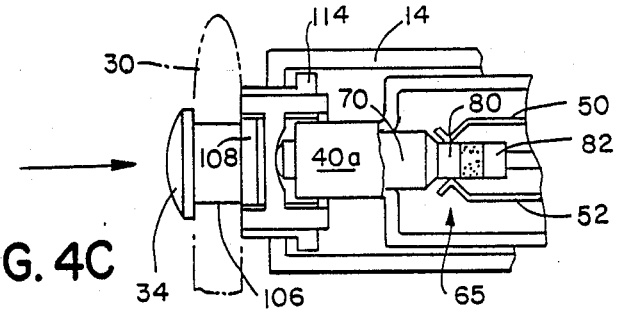

The ability for the operator to easily de-activate the motor by means of the actuator 24 is depicted in FIG. 4C. In that figure, the operator has exerted an inward force against the knob 34 causing the knob 34, tether clip 30 and plunger actuator 100 to move in unison into the housing 14. As seen in FIG. 4C, the ring 114 is spaced from the shoulder 36 while the relative position between the plunger actuator 100 and knob 34 is maintained by the tether clip 30. Inward movement of the actuating member 100 exerts a force against the plunger 70 causing the plunger to move against the biasing action of the spring 72 thereby shorting the terminals 50, 52 with the second metal band 80.

Figure 4D:
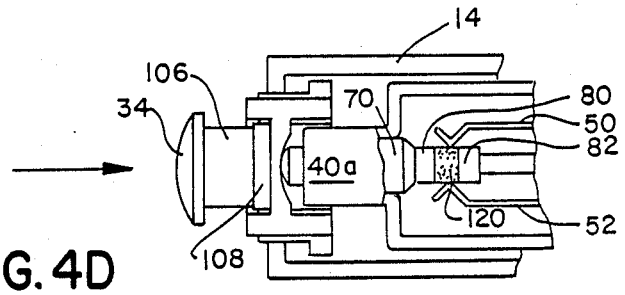

As seen in FIG. 4D, it is possible for the operator to start the boat motor even with the tether clip 30 removed from the actuator 24. This is accomplished by pressing inward on the knob 34 to position the plunger 70 with the insulating portion 120 bridging the two contacts 50, 52. The knob 34 is pressed inward and moves relative to the actuating member 100 until the disk 108 contacts the plunger actuator 100. Subsequent to this contact, the knob 34 and plunger actuator 100 move together as the plunger 70 is pushed into the housing 14 against the biasing action of the spring 72.

This last feature permits the motor boat operator to re-activate the motor even if the tether clip is lost. With the tether clip separated, the operator need only press on the knob 34 to start and run the motor. If for example, the tether clip is lost far from shore, the boat owner can return the boat to shore by holding the knob 34 in the intermediate position shown in FIG. 4D.

The tether clip 30 is constructed from plastic and is flexible. A stem engaging portion of the clip 30 is generally "U" shaped having an open neck portion that slips over the stem 106. To mount the clip 30 over the stem portion 106 of the knob 34, the user brings the neck or open portion of the clip 30 into engagement with the stem 106. Continued pressure against the stem 106 causes the neck portion of the clip 30 to separate and allow the stem 106 to pass through the neck portion to a generally circular opening **30*a* configured to accommodate the stem 106. The neck returns to an unflexed position to hold the clip 30 in place unless and until the flexible tether 32 experiences a force to pull the clip 30 from the actuator 24**.

The flexible terminals 50, 52, are stamped bands, preferably of copper, that are electrically connected by solder or the like to the conductors 60, 62. The terminals 50, 52 and connected conductors 60, 62 are embedded in a body 130 (FIG. 7) of the base portion **40*b* with epoxy cement or the like, and a cap 132 is pressed down over the terminals 50, 52 and glued to the body 130**.

Figure 7:
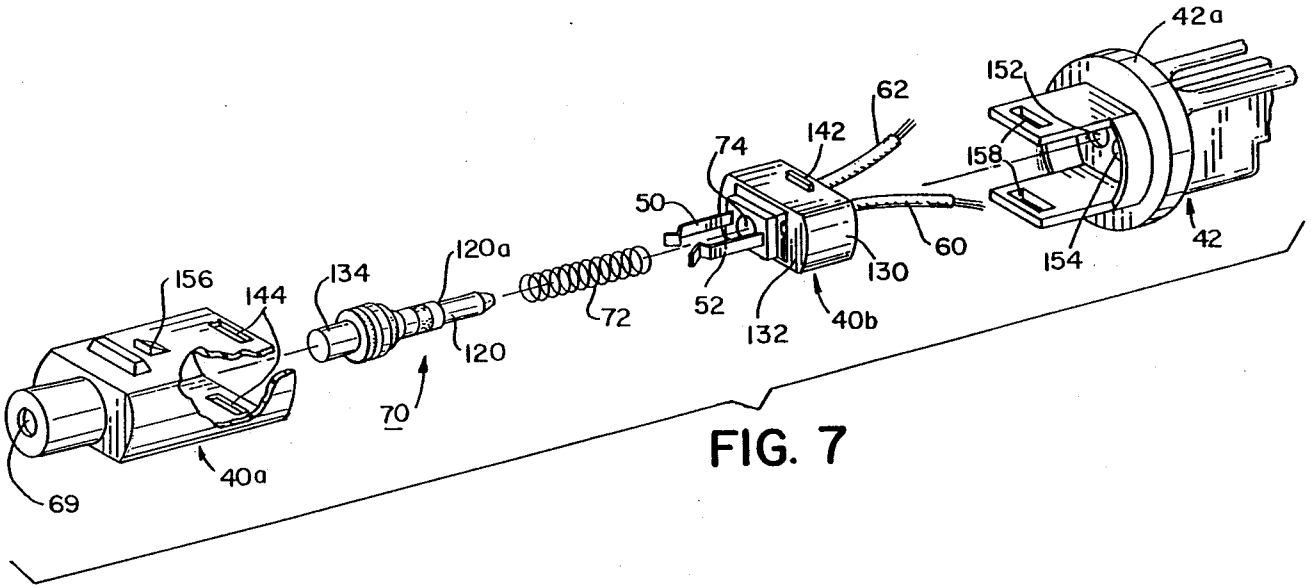
FIG. 7 is an exploded view showing a switch housing.

Turning to FIG. 7, the housing portion **40*a*, the plunger 70, the spring 72, the base portion 40*b* and the throttle base 42 are assembled together. The spring 72 is positioned within the well 74 and the insulating portion 120 of the plunger 70 is inserted into the spring 72 so that the spring 72 may be compressed between the bottom of the well 74 and an end face 120*a* of the insulating portion 120. The housing portion 40*a* is pushed over the assembly of the plunger 70, the spring 72 and the base portion 40*a* so that a distal end 134 of the plunger 70 passes through the opening 69 in the housing portion 40*a* and two tabs 142, one on either side of the base portion 40*b* (only one of which is visible in FIG. 7), lock into two slots 144 on the housing portion 40*a* to hold the switch housing portions together. The switch housing 40*a*, 40*b* is then pushed into throttle base 42 so that the conductors 60, 62 extend out through openings 152, 154 in the throttle base 42 and two tabs 156, one on either side of the housing portion 40*a*, locks into slots 158 in the throttle base 42 to hold the switch housing portions 40*a*, 40*b* and the throttle base 42** together.

Figure 5:
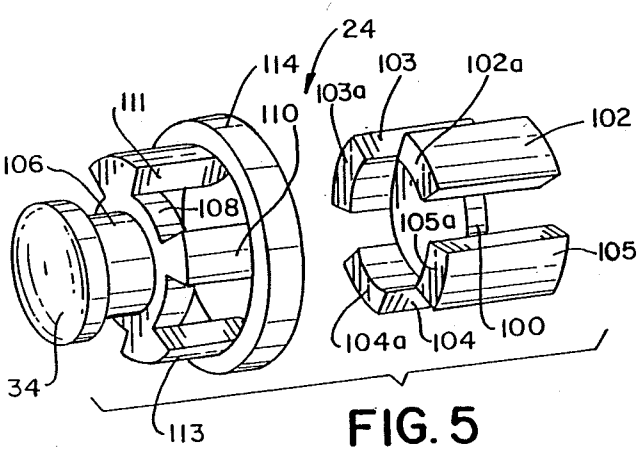
FIG. 5 is a perspective view of two parts that combine to make up the safety switch actuator.

Prior to mounting the throttle 42 on the tiller 10, the push button actuator 24 is assembled by interleaving the two sets of supports 102–105 and 110–113, best shown in FIG. 5. The push button actuator 24 is then pushed through the opening defined by the shoulder 36 of the housing 14, as best shown in FIG. 3. The throttle base 42 is then inserted into the housing 14 until the flared portion **42*a* is trapped by the latch arms 46**.

The present invention has been described with a degree of particularity. It is the intent, however, that the invention include all modifications and/or alterations falling within the spirit or scope of the appended claims.

I claim:

1. Apparatus for controlling the operation of a boat motor comprising:

(a) a housing;

(b) a movable plunger disposed in the housing having first and second contacts;

(c) a switch terminal in continuous sliding contact with the plunger, said switch terminal coupleable to a motor control circuit for de-activating the boat motor when the switch terminal contacts one of said first and second contacts;

(d) biasing means coupled to the plunger for urging the plunger toward a first position in which the switch terminal contact the first contact;

(e) an actuator coupled to the plunger for allowing a boat operator to move the plunger toward the second position; and (f) a clip movably engageable with the actuator so that the clip counters the bias of the biasing means when engaged with the actuator.

2. The apparatus of claim 1 wherein the first and second contacts are each metallic bands affixed on the plunger.

3. The apparatus of claim 1 wherein the plunger includes an isolating portion positioned to allow the boat operator to move the plunger counter the biasing means so that the switch terminal contacts the isolating portion with the clip released from engagement with the actuator.

4. The apparatus of claim 1 wherein the actuator includes first and second push button members movably supported by the housing, the first and second push button members held in a first relative position by the clip for movement in unison to move the plunger in response to operator contact with a first of said first and second push button members and for relative movement in response to removal of the clip to allow the biasing means to move the plunger in the event the clip is moved out of engagement with the plunger.

5. The apparatus of claim 4 wherein:

(a) the first push button member includes a knob defining a contact surface for engagement by a boat operator, a stem coupled to the knob to locate the clip, a first series of circumferentially spaced elongated supports coupled to the stem, and a ring movable with respect to the housing for limiting push button member movement; and (b) the second push button member includes a disk shaped contact member supportingly coupled to the first push button member by a second series of circumferentially spaced elongated supports that interleave with the first series of elongated supports to permit relative movement between the disk shaped contact member of the second member and the knob of the first member in the event the clip is removed from the stem.

6. The apparatus of claim 4 wherein the plunger includes an isolating portion and said first and second push button members are positioned so as to move the plunger against the sense urged by the biasing means toward a position in which the switch terminal contacts the isolating portion of the plunger in response to operator contact with said first push button member after removal of the clip from a stem.

7. Apparatus for controlling operation of a boat motor comprising:

(a) user controllable throttle for adjusting boat motor idle speed; and (b) a switch mounted on said throttle including:

(i) a plurality of spaced apart switch terminals in continuous sliding engagement with a plunger and coupleable to a motor control circuit for de-activating the boat motor;

(ii) said plunger having contact means for bridging the spaced apart switch terminals in either of first and second plunger positions relative to the throttle;

(iii) biasing means coupled to the plunger for urging the plunger toward the first position; and (iv) an actuator coupled to the plunger to allow a boat operator to move the plunger toward the second position; and (v) a clip movably engageable with the actuator so that the clip counters the bias of the biasing means when engaged with the actuator.

8. The apparatus of claim 7 wherein the contact means comprises a pair of metallic bands mounted on the plunger, each of said bands electrically isolated from the other.

9. The apparatus of claim 7 wherein the plunger includes an isolating portion positioned to allow the boat operator to move the plunger counter the biasing means so that the switch terminals contact the isolating portion with the clip released from engagement with the actuator.

10. The apparatus of claim 7 wherein the actuator includes first and second push button members movably supported by a housing, said first and second push button members held in a first relative position by the clip for movement in unison to move the plunger in response to operator contact with a first of said first and second push button members and for relative movement in response to removal of the clip to allow the biasing means to move the plunger in the event the clip is moved out of engagement with the plunger.

11. The apparatus of claim 10 wherein:

(a) the first push button member includes a knob defining a contact surface for engagement by a boat operator, a stem coupled to the knob to locate the clip, a first series of circumferentially spaced elongated supports coupled to the stem, and a ring movable with respect to the throttle for limiting push button member movement; and (b) the second push button member includes a disk shaped contact member supportingly coupled to the first push button member by a second series of circumferentially spaced elongated supports that interleave with the first series of elongated supports to permit relative movement between the disk shaped contact of the second member and the knob of the first member in the event the clip is removed from the stem.

12. The apparatus of claim 10 wherein said first and second push button members are positioned so as to move the plunger against the sense urged by said biasing means and away from either said first position or second position in response to operator contact with said first push button member after removal of the clip from a stem.

13. A method of assembling and then controlling the operation of a boat motor having a circuit for de-activating the motor comprising the steps of:

(a) positioning an insulating plunger between a pair of stationary spaced terminals coupled to the circuit for sliding the plunger against the terminals;

(b) affixing first and second conductors on the plunger for bridging the terminals so that the circuit for de-activating the motor is closed when the terminals are bridged by one of said first and second conductors;

(d) biasing the plunger in a sense tending to move the plunger toward a position in which the terminals are bridged by the first conductor;

(e) positioning a push button plunger actuator against the plunger for moving the plunger toward a position in which the terminals are bridged by the second conductor; and (f) wedging a clip into a position between a retaining knob on the push button plunger actuator and the plunger so as to retard the plunger from reaching the position in which the terminals are bridged by the first conductor.

14. The method according to claim 13 including the additional step of releasing the clip from the position between the knob on the push button plunger actuator and the plunger so that the plunger moves toward the position in which the terminals are bridge by the first conductor.

15. The method of claim 14 including the additional step of pressing the push button plunger actuator so that the plunger moves away from the position in which the terminals are bridged by the first conductor.

16. The method of claim 13 including the additional step of pressing the push button plunger actuator so that the plunger moves toward the position in which the terminals are bridged by the second conductor.

17. A switch in combination with a boat motor having a boat motor de-activation circuit and a throttle control for adjusting boat motor idle speed;

said switch comprising two switch terminals, one of which terminals is electrically connected to the boat motor de-activation circuit so that the boat motor de-activation circuit is closed when the switch terminals are bridged; a conductor for bridging the switch terminals; a biasing means for biasing the conductor toward bridging contact with the switch terminals; an actuator aligned with the conductor and having a knob; and a clip coupleable to the actuator in a position between the knob and the conductor so as to retard the conductor from moving into contact with the terminals;

said boat motor also including a tiller having a central axis and mounting the switch and throttle control to allow a boat operator to move the conductor out of bridging contact with the switch terminals by applying a force on the knob toward the tiller along the central axis.

* * * * *